United States Patent [19]

Matsushiro

[11] 4,059,918

[45] Nov. 29, 1977

[54] TOY VEHICLE

[75] Inventor: Yukimitsu Matsushiro, Tokyo, Japan

[73] Assignee: K. K. Matsushiro, Tokyo, Japan

[21] Appl. No.: 706,330

[22] Filed: July 19, 1976

[30] Foreign Application Priority Data

Aug. 1, 1975 Japan ..... 50-94648

[51] Int. Cl.[2] ..... A63H 29/20

[52] U.S. Cl. ..... 46/209

[58] Field of Search ..... 46/201, 202, 206, 208, 46/209, 212, 221

[56] References Cited

U.S. PATENT DOCUMENTS 2,257,064 9/1941 Muller ..... 46/212

2,625,831 1/1953 Saunders ..... 46/212

*Primary Examiner*—Russell R. Kinsey
*Assistant Examiner*—Robert F. Cutting
*Attorney, Agent, or Firm*—Ladas, Parry, Von Gehr, Goldsmith & Deschamps

[57] ABSTRACT

A toy vehicle, which is driven by the inertia of the rotation of a fly-wheel, wherein the combination of gears connecting the driving wheel and the fly-wheel can be changed by operation of a lever so that the direction of the movement of the vehicle may be changed while the fly-wheel is rotating in one direction, or the driving wheel and the fly-wheel may be disconnected so as to let the fly-wheel idle, is disclosed.

4 Claims, 7 Drawing Figures

TOY VEHICLE

BACKGROUND OF THE INVENTION

This invention relates to a toy vehicle driven by the rotation power of a fly-wheel. More particularly, this invention relates to a toy vehicle which is driven by the rotation power of a fly-wheel and that can be made to move either forward or backward by operation of a lever which changes correlation of the gears placed between the driving gear secured to the wheel shaft and the gear secured to the fly-wheel shaft.

Toy vehicles which are driven by inertia of a rotating fly-wheel have been known. But all the known toy vehicles of this kind are very simple ones, which are provided with a fixed gear system (train of gears) connecting the fly-wheel and the driving wheel shaft. Therefore, they can move only forward when the fly-wheel is rotated in the positive direction by the friction between the floor and the wheels of the vehicle moved forward; and they can move only backward when the fly-wheel is rotated in the reverse direction by moving the vehicle backward on the floor. They are not provided with a lever by operation of which the direction of movement of the vehicle can be changed while the fly-wheel is rotating in one direction.

SUMMARY OF THE INVENTION

This invention provides a new toy vehicle utilizing the inertia of the fly-wheel, eliminating the above-mentioned defect of the known ones. The toy vehicle of this invention can be made to go forward or backward by operating a lever, regardless of the direction of rotation of the fly-wheel, after the fly-wheel is given rotation energy in one direction by pressing the wheels of the vehicle onto the floor and moving the vehicle. And the lever of this vehicle can take a neutral position in which the gear system is disengaged from the fly-wheel and the vehicle wheels, but is temporarily engaged with them only when the fly-wheel is supplied with the rotation energy either in the positive direction or in the reverse direction, and yet, once the fly-wheel has been energized for rotation, the gear system is again automatically disengaged from the fly-wheel and the vehicle wheels. Thereafter, the vehicle can be made to go forward or backward by operation of the lever. Further, if the moving vehicle runs into something or a barrier, the impact automatically puts the gears in neutral and thus the gear system is released from overload.

Now the invention is explained in detail with reference to the attached drawings.

BRIEF EXPLANATION OF THE DRAWINGS

The attached drawings represent an embodiment of the toy vehicle of this invention.

DETAILED DESCRIPTION OF THE INVENTION

Figure 1:
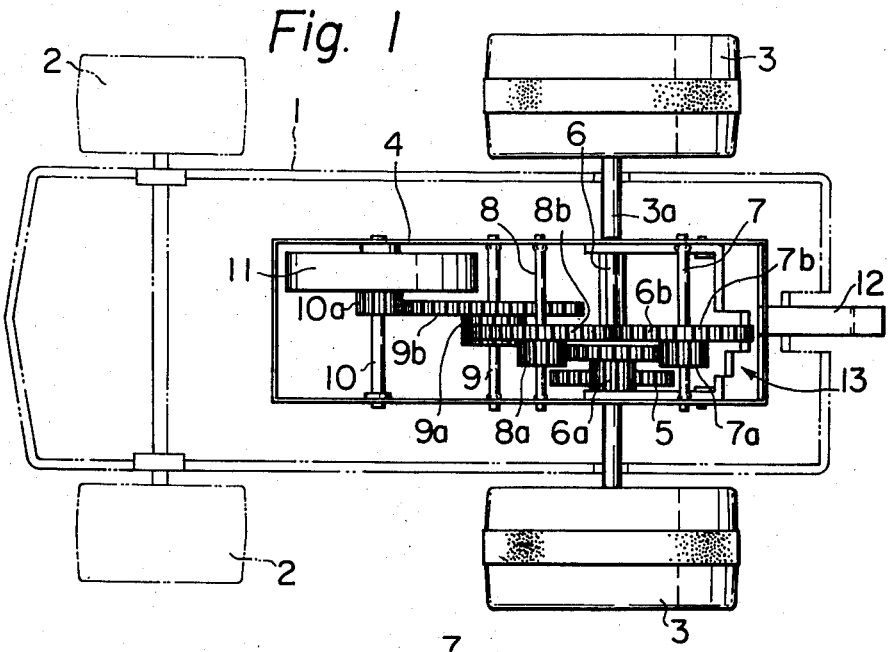
FIG. 1 is the plan view of the gear system of the vehicle.
Figure 2:
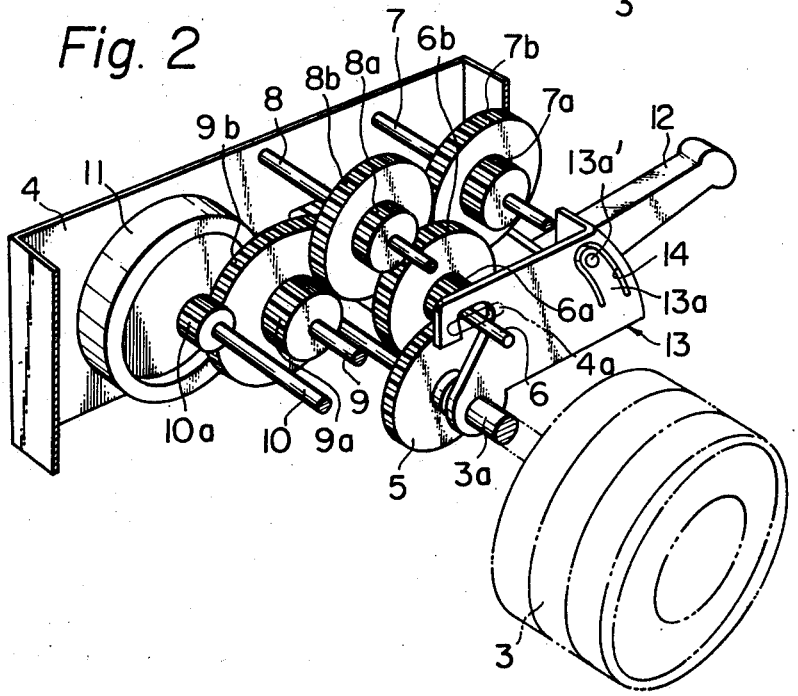
FIG. 2 is the schematic perspective view showing the mechanism of the gear system.

The vehicle body is represented by 1. Member 2 is front wheels, 3 is rear wheels or driving wheels in this case. 3*a* is the shaft for the rear wheels. Member 4 is a frame supporting the gear system, or a train of gears. Driving gear 5 is secured to shaft 3*a*. An idler gear 6*a* secured to a shaft 6 is engaged with said driving gear 5 from above. Both ends of said shaft 6 are received in elongated holes or short slots 4*a* provided in the side walls of the frame 4, and the shaft 6 can move to and fro in these slots, whereby the driving gear 5 and the idler gear 6*a* are always interlocked whatever positions the shaft 6 takes in the slots 4, although the meshing becomes deep or shallow.

The shaft 6 has another larger gear 6*b* secured thereon. This idler gear 6*b* can be meshed with either of a first driven gear 7*a* and a second driven gear 8*a*, or can stand neutral free from both of them according to the position that the shaft 6 takes in the slots 4*a*, said driven gears 7*a* and 8*a* being provided above said idler gear on both sides thereof. The shafts 7 and 8 of said driven gears 7*a* and 8*a* respectively have a larger gear 7*b* and 8*b* secured thereon and said gears 7*b* and 8*b* are in the fixed positions and interlock with each other all the time. A third driven gear 9*a* secured on shaft 9 is engaged with said second driven gear 8*b*, and, at the same time, a larger gear 9*b* secured on shaft 9 is engaged with a small gear 10*a* secured to shaft 10 on which fly-wheel 11 is secured, and thus the rotation power is delivered to the fly-wheel.

Figure 7:
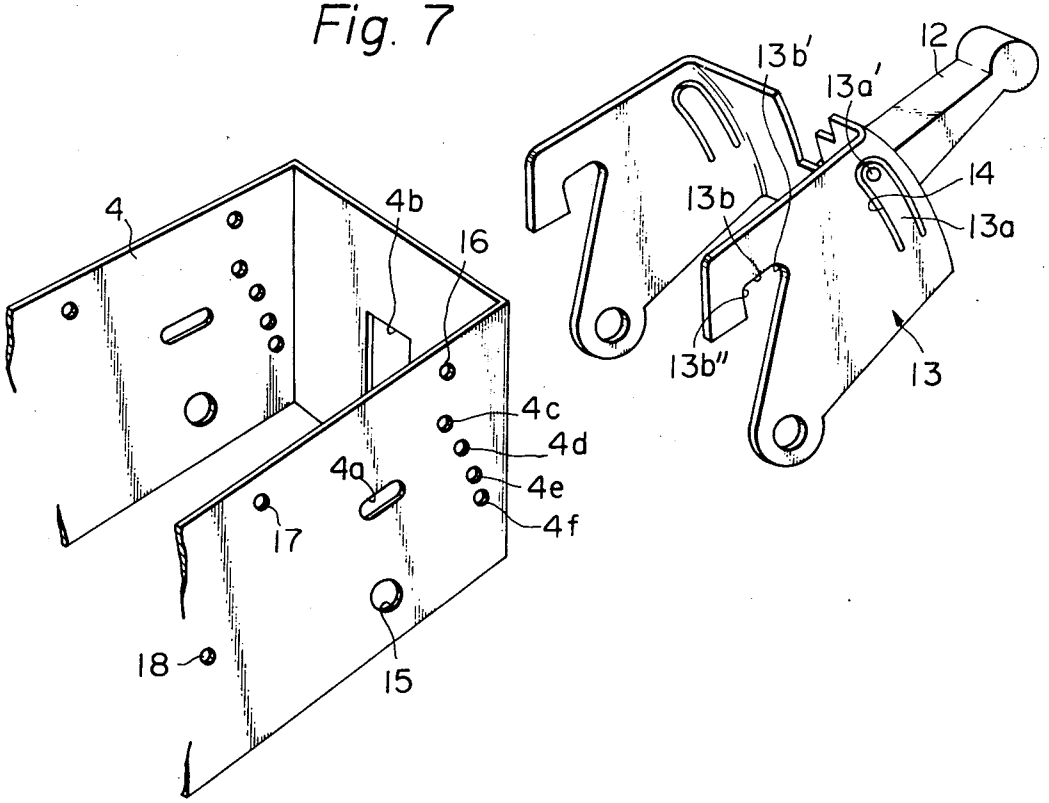
FIG. 7 is the schematic perspective view showing the relation between the gear frame and the lever.

A lever 12 having a supporting frame 13 which is of square parenthesis shape in horizontal section is protruded through an indentation 4*b* provided in the back wall of the frame 4. The supporting frame is placed inside the gear frame 4 and is pivotably supported on the wheel shaft 3*a*. In this supporting frame 13, an arcuate tongue-like resilient member 13*a* is formed by incision 14, the center of curvature of said arcuate member residing at the wheel shaft 3*a*. At the end of this arcuate resilient member is provided a small boss 13*a'*, and said boss can be snapped into one of four small round holes 4*c*, 4*d*, 4*e* and 4*f* provided in the side walls of the gear frame 4 according to operation of the lever 12. The lever-supporting frame 13 has an indentation 13*b*, which interlocks with the shaft 6 of the gears 6*a* and 6*b* and displaces said shaft along the slot 4*a* when the lever 12 is operated. When the small boss 13*a'* is placed in the hole 4*c*, the gears 6*b* and 8*a* interlock, and when the boss 13*a'* is placed in 4*f*, the gears 6*b* and 7*a* interlock. But when the boss 13*a'* is placed in the hole 4*d* or 4*e*, the idler gear 6*b* does not mesh with either gear 7*a* or 8*a*. In FIGS. 7; 15, 16, 17 and 18 are holes respectively receiving the shaft 3*a*, 7, 8 and 9.

As has been understood from the above explanation, the correlation between the idler gear 6*b* and driven gears 7*a* and 8*a* can be changed in 4 steps as the boss 13*a'* is displaced from the hole 4*c* to 4*f* through 4*d* and 4*e* by the operation of the lever 12, with which the shaft 6 is displaced along the slot 4*a* in 4 steps.

Figure 4:
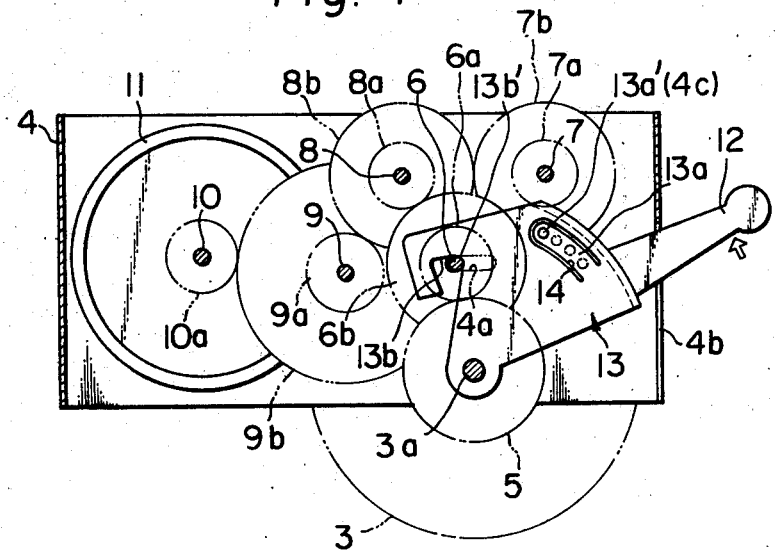

That is to say, when the lever 12 is placed in the first position (4*c*), as seen in FIG. 4, the shaft 6 is blocked by an edge 13*b'* of the indentation 13*b* and is placed at one end of the slot 4*a*. Then gear 6*b* and gear 8*a* interlock, and thus a gear system consisting of an odd number of gears 5→6*a*, 6*b*→8*a*, 8*b*→9*a*, 9*b*→10*a*, is formed from the wheel shaft 3*a* to the fly-wheel. Therefore, if the vehicle is moved forward on the floor, the rotation power is delivered to the fly-wheel through said gear system to rotate the fly wheel in the positive direction. If the vehicle is moved backward on the floor, the fly-wheel rotates in the reverse direction. That is, the vehicle runs in the same direction as that of the fly-wheel rotation.

Figure 5:
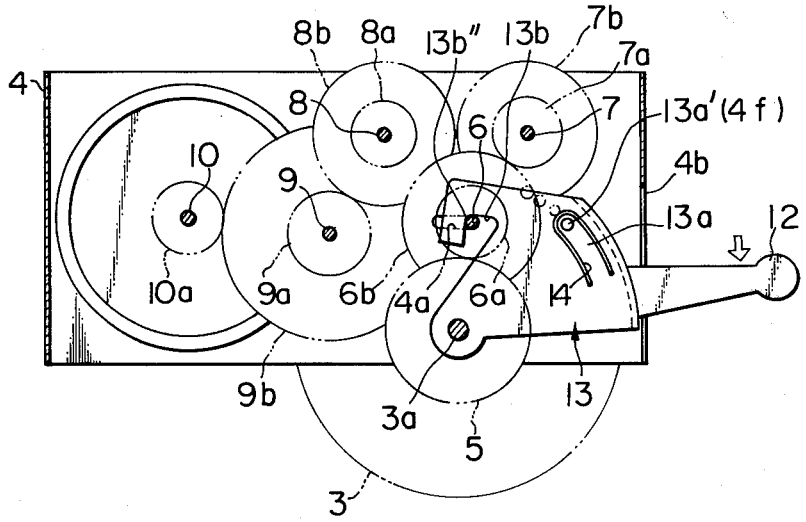

To the contrary, when the lever 12 is placed in the fourth position (*4f*), as shown in FIG. 5, the shaft 6 is blocked by the other edge 13*b*″ of the indentation 13*b* and is placed at the other end of the slot 4*a*. Then gears 6*b* and 7*a* interlock, and thus a gear system consisting of an even number of gears, 5→6*a*, 6*b*→7*a*, 7*b*→8*b*→9*a*, 9*b*→10*a* is formed from the driving gear 5 to the fly-wheel 11. Therefore, if the vehicle is moved forward on the floor, the rotation power is delivered to the fly-wheel through said gear system to rotate the fly-wheel in the reverse direction. If the vehicle is moved backward, the fly-wheel rotates in the positive direction.

Figure 3:
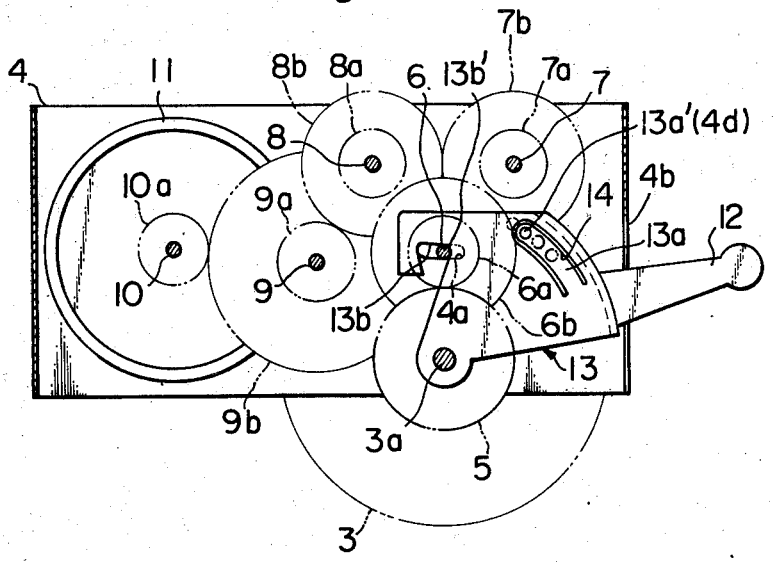
FIGS. 3, 4, 5 and 6 are schematic sectional views respectively showing the correlation of the gears for each of the four positions of the lever.

Further, when the lever 12 is placed in the second position (*4d*), as shown in FIG. 3, the shaft 6, which is in the neutral position wherein the idler gear 6*b* interlocks with neither gear 7*a* nor 8*a*, is allowed to move forward but is prevented by the edge 13*b*′ from moving backward. Under this condition, therefore if the rear wheels 3 are rotated in the direction the vehicle moves backward, the shaft cannot move backward and the idler gear 6*b* does not interlock with gear 7*a* and thus it merely rotates idle, and the fly-wheel is not energized. But, if the rear wheels 3 are rotated in the direction the vehicle moves forward, the idler gear 6*b* is pushed forward so as to interlock with the gear 8*a* and when the fly-wheel is energized. But the meshing between the gears 6*b* and 8*a* is only temporary, and the driving motion applied to the vehicle is ceased, the gear 6*b* is automatically disengaged from the gear 8*a* and the shaft 6 returns to the initial neutral position.

Figure 6:
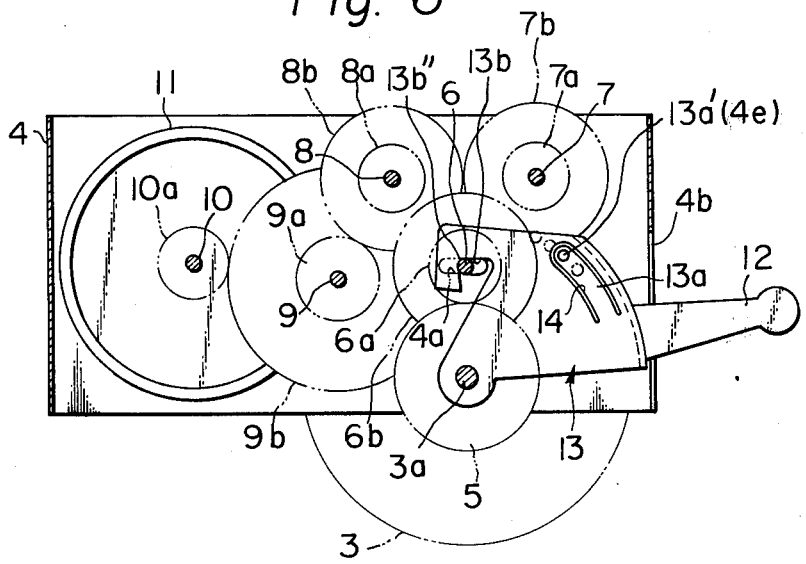

Finally, when the lever 12 is placed in the third position (*4e*), as shown in FIg. 6, the shaft 6, which is in the neutral position wherein the idler gear 6*b* interlocks neither with gear 7*a* nor 8*a*, is, contrary to the second position, allowed to move backward, but not forward being blocked by the edge 13*b*″. Under this condition, therefore, if the rear wheels 3 are rotated in the direction the vehicle moves forward, the shaft 6 cannot move forward and the idler gear 6*b* does not interlock with gear 8*a*, and thus it merely rotates idle, and the fly-wheel is not energized, But, if the rear wheels 3 are rotated in the direction the vehicle moves backward, the idler gear 6*b* is pushed backward, so as to interlock with the gear 7*a* and the fly-wheel is rotated in the reverse direction. But again, the meshing between the gear 6*b* and 7*a* is only temporary, and when the backward driving motion of the vehicle is ceased, the gear 6*b* is automatically disengaged from the gear 7*a* and the shaft 6 returns to the initial neutral position.

Therefore, this toy vehicle can be played with in the following eight ways.

1. Place the lever 12 in the first position, press the rear wheels 3 onto the floor and move the vehicle forward to rotate the fly-wheel 11 in the positive direction and let the vehicle run forward by the inertia of the fly-wheel rotation.
2. Place the lever 12 in the first position, press the rear wheels 3 onto the floor and move the vehicle backward to rotate the fly-wheel 11 in the reverse direction and let the vehicle run backward by the inertia of the fly-wheel rotation. But in this case the lever must be held in place by the hand lest the lever should move to the neutral position, when the fly-wheel is energized.
3. Place the lever 12 in the fourth position, press the rear wheels 3 onto the floor and move the vehicle forward to rotate the fly-wheel 11 in the reverse direction and let the vehicle run forward by the inertia of the fly-wheel rotation. In this case the lever must be held in place by the hand lest the lever should move to the neutral position, too, when the fly-wheel is energized.
4. Place the lever 12 in the fourth position, press the rear wheels 3 onto the floor and move the vehicle backward to rotate the fly-wheel in the positive direction and let the vehicle run backward by the inertia of the fly-wheel rotation.
5. Place the lever 12 in the second position, press the rear wheels 3 onto the floor and move the vehicle forward so as to rotate the fly-wheel 11 in the positive direction, and then shift the lever 12 to the first position letting the vehicle run forward.
6. Place the lever 12 in the second position, press the rear wheels 3 onto the floor and move the vehicle forward so as to rotate the fly-wheel 11 in the positive direction, and then shift the lever 12 to the fourth position letting the vehicle run backward.
7. Place the lever 12 in the third position, press the rear wheels 3 onto the floor and move the vehicle backward so as to rotate the fly-wheel 11 in the positive direction, and then shift the lever 12 to the first position letting the vehicle run forward.
8. Place the lever 12 in the third position, press the rear wheels 3 onto the floor and move the vehicle backward so as to rotate the fly-wheel 11 in the positive direction, and then shift the lever 12 to the fourth position letting the vehicle run backward.

It is the normal way of playing with this toy to let the vehicle run forward by moving it forward when the lever is in the first position, to let the vehicle run backward by moving it backward when the lever is in the fourth position. In this case, when the vehicle is moving forward under the condition as shown in FIG. 4 with the lever 11 in the first position, if the vehicle bumps against something or a barrier, force is applied to the shaft 6 so as to move it backward in the slot 4*a* by virtue of the inertia of the rotation of the fly-wheel 11, and consequently the lever is shifted to the second position and thus the gear 6*b* is shifted to the neutral position. In this way the rotation energy of the fly-wheel is freed and thus the gears are smoothly released from overload. In the same way, when the vehicle is moving backward under the condition as shown in FIG. 5 with the lever 12 in the fourth position, if the vehicle bumps into something or a barrier, force is applied to the shaft 6 so as to move it forward in the slot 4*a* by virtue of the inertia of the rotation of fly-wheel 11, and consequently the lever is shifted to the third position and thus the gear 6*b* is shifted to the neutral position, too.

As has been explained above, in the toy vehicle of this invention, the gear system connecting the driving wheels of the vehicle and the fly-wheel can be changed by the operation of the lever, and thus fly-wheel can be rotated either in the positive direction or in the reverse direction by moving the vehicle in a desired direction, forward or backward, and the vehicle can be moved forward or backward by operation of the lever regardless of the direction of the fly-wheel rotation. Therefore, this toy vehicle can be operated in various ways in comparison with the conventional fly-wheel toy vehicles of this kind. Further, when the vehicle runs against a barrier during its forward or backward movement, the gear system is automatically shifted to neutral, and the rotation energy of the fly-wheel is freed and the gears are smoothly released from overload.

Although the invention has been explained in detail specifically with regard to an embodiment thereof, it should be understood that various modifications are possible within the scope of the attached claims and the spirit of the invention. For instance, in the above-explained embodiment, the rear wheels are driving wheels. But the front wheels can be driving wheels. Number and combination of the gears can be varied, too.

What is claimed is:

1. A toy vehicle comprising:

at least one ground-engaging drive wheel;

a flywheel;

a gear train for connecting the drive wheel and the flywheel whereby the drive wheel can be employed to bring about rotation of the flywheel and the inertia of the flywheel when rotating can be employed to bring about rotation of the drive wheel, the gear train including a drive gear connected to the drive wheel, an idler gear in meshing engagement with the drive gear, and at least first and second additional gears;

an idler gear shaft upon which the idler gear is mounted and which is displaceable between a position in which the idler gear meshes with said first additional gear, and the drive wheel and the flywheel are connected through an even number of gears including said idler gear and said first additional gear, and a position in which the idler gear meshes with said second additional gear, and the drive wheel and the flywheel are connected through an odd number of gears including said idler gear and said second additional gear, the idler gear shaft having at least one intermediate position in which it meshes with neither the first additional gear nor the second additional gear; and a lever coupled to the idler gear shaft and operable to displace said idler gear shaft without breaking meshing engagement of the drive gear and the idler gear, the lever having a first position in which the idler gear shaft is positioned so that the idler gear meshes with the first additional gear, a second position in which the idler gear shaft is positioned so that the idler gear meshes with neither the first additional gear nor the second additional gear and the idler gear shaft is prevented from moving to a position in which the idler gear engages the second additional gear but is free to move to a position in which the idler gear engages the first additional gear and is urged towards engagement with the first additional gear by the drive gear when the drive wheel is rotated in one sense, a third position in which the idler gear shaft is positioned so that the idler gear meshes with neither the first additional gear nor the second additional gear and the idler gear shaft is prevented from moving to a position in which the idler gear engages the first additional gear but is free to move to a position in which the idler gear engages the second additional gear and is urged towards engagement with the second additional gear by the drive gear when the drive wheel is rotated in the sense opposite to said one sense, and a fourth position in which the idler gear shaft is positioned so that the idler gear meshes with the second additional gear.

2. A toy vehicle as claimed in claim 1, comprising a gear frame having first and second side walls between which the idler gear is positioned, the side walls of the gear frame being formed with respective elongate slots in which the opposite ends of the idler gear shaft are respectively fitted, so that the idler gear shaft is displaceable transversely of its length, and wherein the lever includes first and second plate form members disposed adjacent the side walls respectively of the gear frame and defining respective indentations through which the idler gear shaft extends, the indentations in the plate-form members and the slots in the side walls of the gear frame cooperating with one another so that when the lever is in its first and fourth positions the idler gear shaft is secured against displacement transverse to its length, whereas when the lever is in its second and third positions, the idler gear shaft is secured against displacement in one direction transverse to its length but is not secured against displacement in another direction.

3. A toy vehicle as claimed in claim 1, wherein the drive wheel is mounted on a drive wheel shaft, and the lever is mounted to pivot about the axis of the drive wheel shaft.

4. A toy vehicle as claimed in claim 3, comprising a gear frame in which the gear train is mounted and wherein the lever has an arcuate resilient portion whose center of curvature lies on the axis of the drive wheel shaft, the gear frame is formed with four small holes, and the resilient portion has a boss which engages in the four small holes to determine respectively said first, second, third and fourth positions of the lever.

* * * * *